United States Patent [19]

Greis

[11] Patent Number: 4,528,946

[45] Date of Patent: Jul. 16, 1985

[54] INTERMEDIATE SUPERHEATER

[75] Inventor: Ingemar Greis, Sturefors, Sweden

[73] Assignee: Stal-Laval Apparat AB, Linköping, Sweden

[21] Appl. No.: 486,893

[22] Filed: Apr. 20, 1983

[30] Foreign Application Priority Data

Apr. 22, 1982 [SE] Sweden ..... 8202525

[51] Int. Cl.[3] ..... F22G 1/00

[52] U.S. Cl. ..... 122/483; 122/32; 122/34

[58] Field of Search ..... 122/31 R, 32, 34, 36, 122/441, 444, 459, 460, 467, 468, 476, 483, 484

[56] References Cited

U.S. PATENT DOCUMENTS

| | | | |
|---|---|---|---|
| 3,683,866 | 8/1972 | Zmola | 122/34 |
| 3,848,572 | 11/1974 | Giardina | 122/32 |
| 4,156,403 | 5/1979 | Bessouat et al. | 122/34 |
| 4,248,181 | 2/1981 | Bessouat et al. | 122/34 |
| 4,261,298 | 4/1981 | McDonald et al. | 122/34 |
| 4,352,341 | 10/1982 | Styslinger | 122/32 |

FOREIGN PATENT DOCUMENTS

| | | | |
|---|---|---|---|
| 6600647 | 7/1966 | Netherlands | 122/32 |

*Primary Examiner*—Edward G. Favors
*Assistant Examiner*—Steven E. Warner
*Attorney, Agent, or Firm*—Watson, Cole, Grindle & Watson

[57] ABSTRACT

A superheater has a pressure vessel containing upper and lower steam chambers for primary steam between which extends a nest of tubes arranged around a central volume. The volume between the nest of tubes and the pressure vessel is divided into lower and upper volumes by a wall which forces the secondary fluid to be superheated first to pass the nest of tubes radially inwardly into the central volume and thereafter radially outwardly. Primary steam is supplied to the upper steam chamber tangentially and flows under condensation through the tubes to the lower steam chamber where the condensate is discharged. Between the steam chambers a centrally located return conduit can be provided. The rotation of the steam within the upper steam chamber induces a pressure distribution with decreasing pressure from the periphery towards the center which pressure distribution is used for the recirculation of excess primary steam through the return conduit.

11 Claims, 5 Drawing Figures

INTERMEDIATE SUPERHEATER

TECHNICAL FIELD

The present invention relates to an intermediate superheater which is primarily intended for superheating steam (secondary steam) in a nuclear power plant, in which surplus heat is taken from condensing steam (primary steam) from a reactor or a steam generator. The invention can, however, also be used in other plants where condensing steam is used as a heating medium.

DISCUSSION OF PRIOR ART

Single-flow intermediate superheaters are known in which several substantially vertical nests or bundles of tubes are arranged in a reactor pressure vessel and in which the heating steam (the primary steam) condenses inside the tubes and the steam which is heated (the secondary steam) passes transversely of the nest of tubes. In the known intermediate superheaters a major part of the heat transfer between the primary and secondary steam takes place in the outer tubes of the nest or bundle which are first contacted by the secondary steam. This means that more primary steam is condensed inside these outer tubes than in tubes situated further inside the nest or bundle of tubes. Complete condensation of primary steam may occur in one part of the nest or bundle, whereas surplus steam may be present in another part. This results in an accumulation of water and non-condensable gases (for example, air) in stagnant portions of the nest or bundle, thus downgrading the heat transfer coefficient in those portions. Other disadvantages of this non-uniform operation throughout the nest or bundle of tubes are the risk of corrosion damage and the appearance of large temperature differences between the tubes.

A previously known method of avoiding the above-mentioned disadvantages has been to considerably increase the rate of steam flow through the tubes so that surplus steam is present in all parts of the tube nest or bundle and to recirculate the surplus steam from the tube outlet to the tube inlet. To obtain a guaranteed steam flow in all the tubes under all operating conditions, the recirculation requirement in the known superheaters is between 100 and 150% of the supplied quantity of primary steam. The recirculation is achieved by means of ejectors which are driven by the primary steam supplied. Each tube nest requires its own recirculation system with ejectors and its own drainage system for discharging condensate. The disposition of the necessary pipes is complicated and a large number of complicated, expensive seals between the tubes of each nest are required.

OBJECT OF THE INVENTION

One object of the present invention is to provide a simplified and improved intermediate superheater with a larger capacity per unit of volume.

SUMMARY OF THE INVENTION

An intermediate superheater according to the invention comprises a pressure vessel having at least one nest of tubes. Suitably, a steam dryer for the secondary steam is positioned in, or is connected to, the pressure vessel. In the steam dryer moisture is removed from the secondary steam before said steam reaches the tube nest where it is superheated. Inside the pressure vessel, tubes are arranged around a central volume and are connected at the top to an inlet steam chamber and at the bottom to an outlet steam chamber. The central volume is thus defined by the nest of tubes, which are suitably arranged annularly around the central volume, and at the top and bottom by the steam chambers. At least one return conduit for recirculation of excess primary steam desirably connects the steam chambers together. A single return conduit located centrally inthe central volume is preferred.

Between the nest of tubes and the wall of the pressure vessel, there is a volume which is suitably annular. In the pressure vessel an annular wall can be provided which divides up the volume between the pressure vessel wall and the nest of tubes into a lower portion and an upper portion. In this way, the secondary steam, which is to be superheated, will be forced to pass through the nest of tubes radially inwardly and thus transversely of the tubes from one volume outside the nest of tubes into the central volume, vertically within the central volume and thereafter radially outwardly transversely of the nest of tubes to the second volume between the nest of tubes and the wall of the pressure vessel.

The volume between the nest of tubes and the wall of the pressure vessel can also be divided into three or more parts by radially disposed walls and the central volume may also be divided into two or more parts by radial walls. With such an arrangement, the secondary steam, which is to be heated, will be forced repeatedly to pass radially transversely of the tubes in the tube nest.

A small amount of primary steam is desirably continuously discharged from the primary system to maintain the concentration of non-condensable gases below an acceptable level.

Suitably, the pressure vessel and the nest of tubes therein are arranged vertically but can, of course, also be arranged differently, for example horizontally. In a vertical superheater, the secondary steam, which is to be superheated, can flow either from below and upwards or from above and downwards.

In a vertical superheater the steam chambers desirably have a circular-horizontal cross-section. The nest of tubes can be connected to the steam chambers annularly near the peripheries thereof. The primary steam is supplied to the upper chamber and condensate created within the nest of tubes is discharged from the lower one. The primary steam is introduced tangentially into the upper chamber (e.g., at the periphery thereof) so that the steam in the inlet chamber acquires a strong rotating movement which induces a radial pressure gradient in the upper chamber, with the pressure lowest at the center and highest at the periphery above the inlets to the tubes forming the nest. This radial pressure difference constitutes the driving force for ensuring the recirculation of excess primary steam from the lower to the upper chamber through the return conduit(s). Because the secondary system is superheated both when flowing inwardly and outwardly through the layers of tubes forming the nest, a more uniform condensation of the primary steam in the tubes of the different layers in the nest is obtained. In this way, and because the radial pressure difference at the tube inlets in the upper steam chamber gives a higher steam flow in the outer tube layers than in the inner ones, the need for recirculation of primary steam will be considerably lower than in the previously known superheaters. By the invention, special ejectors with complicated tube systems for the recirculation of primary steam can be dispensed with. In this way, the design of the superheater can be simplified and its production rendered less expensive. Another advantage is that the superheater can be constructed symmetrically and in a very compact manner so that a high capacity per unit of volume is obtained. By constructing the superheater so that the secondary steam passes the nest of tubes radially a number of times, the condensation within the nest can become so uniform that it may be possible to operate with such a small amount of primary steam in the lower steam chamber, that there is no need to employ a return conduit.

In a special embodiment of superheater according to the invention, a plurality of return conduits or conduits for discharge of primary steam are mounted in such a way that they are traversed by the secondary steam so that further condensation of the primary steam occurs in these conduits also.

The pressure difference induced between the outer and inner portions of the input steam chamber can be increased by arranging suitable means within the chamber. For example, the input steam chamber can be divided into an upper and a lower volume by a radially disposed annular wall which sealingly engages the outer wall of the input steam chamber. The opening at the center of this annular wall is adapted to the operating conditions and should normally have a diameter which is larger than 30% of the diameter of the input steam chamber. The steam inlet opens out tangentially into the upper space of the steam chamber, whereas the tubes open out into the lower one.

BRIEF DESCRIPTION OF DRAWINGS

Two embodiments of heater in accordance with the invention wil be described in greater detail, by way of example, with reference to the accompanying drawings, in which.

DESCRIPTION OF PREFERRED EMBODIMENTS

Figure 1:
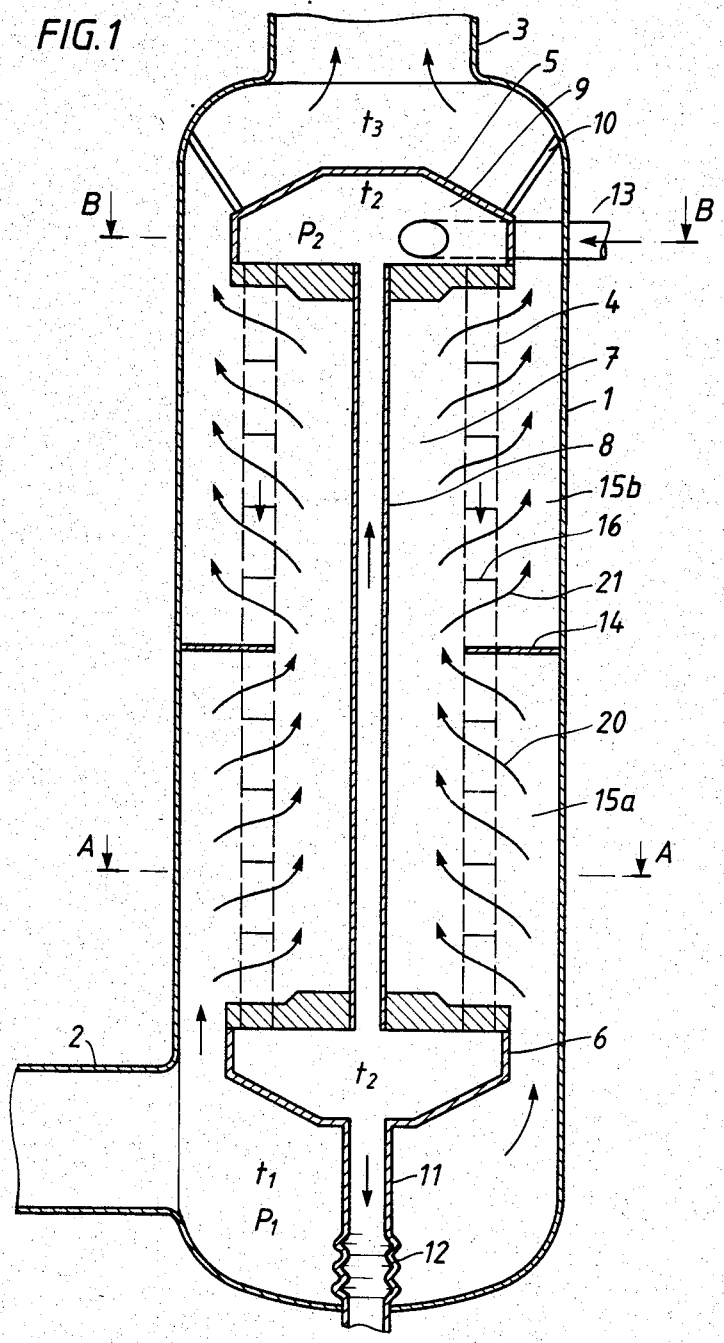
FIG. 1 is a vertical section through a first embodiment of intermediate superheater.
Figure 2:
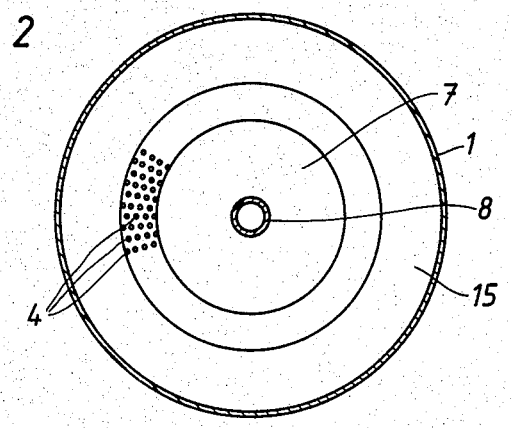
FIG. 2 is a horizontal section on the line A—A in FIG. 1.
Figure 3:
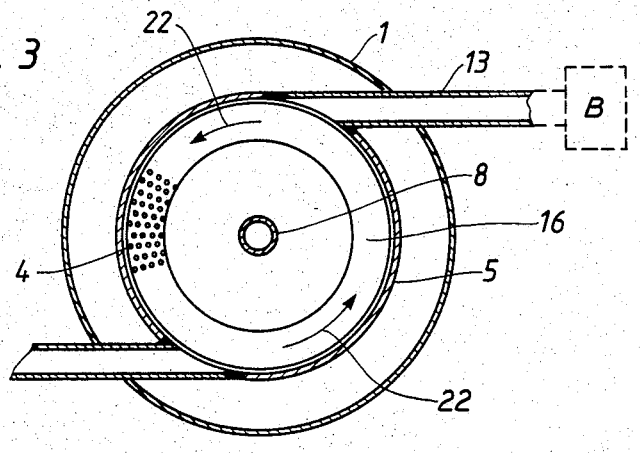
FIG. 3 is a horizontal section through the upper steam chamber on the line B—B in FIG. 1.

In FIGS. 1 to 3, 1 designates a reactor pressure vessel. Secondary steam, which is to be superheated, flows into the pressure vessel 1 through a conduit 2. Moisture in the steam is separated in a steam dryer (not shown) which may be connected to the superheater or arranged inside the pressure vessel. A large number of vertical tubes 4 are arranged in the pressure vessel 1 in an annular tube nest. For example, 25 cylindrical layers of tubes may make up the tube nest. Each tube 4 is connected to an upper steam chamber 5 and a lower steam chamber 6. In the cylindrical volume 7 defined within the tube nest there is a recirculation conduit 8 for allowing steam to transfer from the lower steam chamber 6 back up to the upper steam chamber 5. The entire tube nest, with its steam chambers 5 and 6, is shown suspended within the pressure vessel 1 by means of supporting members 10, but other means may be employed to provide the necessary support. A condensate conduit 11, with a compensator 12 capable of accommodating changes in length of the tube nest, is connected to the steam chamber 6. One or more steam conduits 13 is/are connected tangentially to the upper steam chamber 5. Primary steam is supplied to the superheater through the conduit(s) 13, for example, from a boiler reactor or steam generator B (see FIG. 3). Because of the tangential connection of the conduit(s) 13, the steam in the volume (9) defined by the upper steam chamber 5 will rotate as shown by the arrows 22 (see FIG. 3). At a location approximately half way along the length of the pressure vessel 1, a horizontal annular wall 14 is provided which divides the annular volume (15) between the nest of tubes 4 and the wall of the pressure vessel 1 into a lower volume 15*a* and an upper volume 15*b*. The tubes 4 are supported one relative to the others in the nest at a number of levels by annular stay plates 16 which close the gaps between the separate tubes of the nest. Part of the wall 14 also serves as one of these stay plates.

Figure 4:
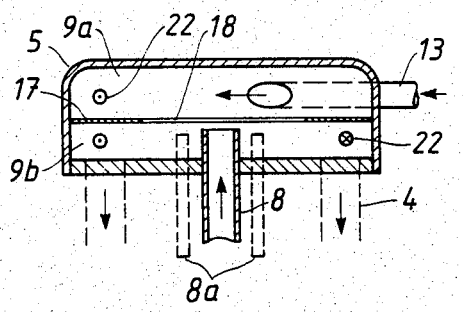
FIG. 4 is a scrap vertical section through an upper steam chamber of an alternative embodiment.

In the embodiment of the steam chamber shown in FIG. 4, the volume 9 is divided into an upper portion 9*a* and a lower portion 9*b* by a wall 17 provided with a central opening 18.

Figure 5:
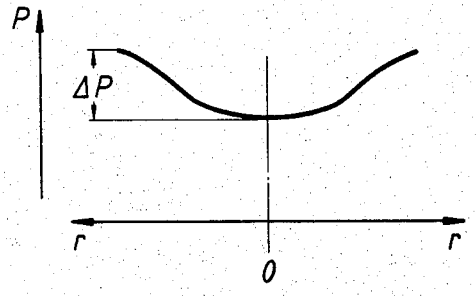
FIG. 5 shows the pressure variation which arises in the radial direction in a steam chamber according to FIG. 4.

FIG. 5 shows how the pressure (P) of the steam in a steam chest 5 of an embodiment according to FIG. 4 varies with the radius r due to the rotational flow of the steam. Between the center O and the outer radius a pressure difference of $\Delta P$ is produced.

The secondary steam, which is to be superheated, is supplied to the pressure vessel through the conduit 2, flows up into the annular volume 15*a* and then radially inwardly through the annular nest of tubes 4, as indicated by the arrows 20, to the cylindrical volume 7. In this volume the secondary steam flows upwards and then radially outwardly, as indicated by the arrows 21, through the tube nest to the annular volume 15*b*, and finally out through the conduit 3. This generally upwardly flowing steam is heated by heating steam supplied to the steam chamber 5 and partially condenses as it flows downwards through the tubes 4. The condensate leaves the vessel 1 through the conduit 11. Since steam in different tubes 4 in the nest of tubes condenses differently, it is necessary to operate with a certain steam surplus which flows out from the bottom of the tubes 4 in order to ensure there is a controlled downward flow to the steam chamber 6 in all the tubes in the nest. Without such a steam surplus, steam in the chamber 6 could flow upwards in certain heavily cooled tubes 4 and cause operating problems. Since the steam which is to be superheated passes around the nest of tubes at least twice-once radially inwardly and once radially outwardly-a more uniform cooling of the tubes 4 is obtained in the different radial layers within the nest of tubes. In this way, it is possible to operate with a small excess of steam in the tubes 4. The radial pressure difference $\Delta P$, caused by the steam rotation induced in the upper steam chamber 5, provides the necessary driving force for returning the surplus steam from the lower steam chamber 6 to the upper steam chamber 5 via the conduit 8. The pressure variation generated in a radial direction in the chamber 5 also results in a somewhat greater quantity of steam flowing down through the radially outer layers of tubes 4, which are the tubes which are most heavily cooled and where therefore the condensation and the steam requirement are greater than in the radially inner layers of tubes. This fact also contributes to maintaining the necessary steam surplus at a low level. The secondary steam flow may of course, within the scope of the invention, just as well be in the opposite direction, i.e., to be fed into the vessel 1 via the conduit 3 and leave the vessel 1 through the conduit 2.

To improve the heat transfer between the primary and secondary steam, the return conduit 8 shown in FIGS. 1 to 4 can be replaced by a small nest of smaller bore conduits (e.g., as shown at 8*a* in FIG. 4).

In a nuclear power plant, the pressure P of the secondary steam which is supplied to the superheater may be about 8 bar and the temperature about 170° C. The pressure $P_2$ and the temperature $t_2$ of the primary steam supplied to the upper steam chamber 5 may be about 65 bar and 280°C., respectively. The superheated steam may have a temperature $t_3$ which may amount to about 260° C. In a larger power plant, the secondary steam flow to a superheater is great and may amount to about 600 kg/s, and for superheating this amount of steam, ~70 kg/s of primary steam may be needed.

The embodiments of the invention specifically described above are examples only and many modifications may be made thereto within the scope of the following claims.

What is claimed is:

1. A superheater which has a simple construction and a large capacity per unit volume, said superheater comprising an elongated pressure vessel having a first end and a second end, said pressure vessel including an inlet conduit near the first end thereof for the introduction of secondary steam to be superheated and an outlet conduit near the second end thereof for the removal of the secondary steam which has been superheated, superheating means located within said elongated pressure vessel, said superheating means including an inlet steam chamber, a supply conduit for supplying primary steam to be condensed to said inlet steam chamber, an outlet steam chamber, a drainage conduit for removing steam condensate from said outlet steam chamber, an annular nest of tubes extending between said inlet steam chamber and said outlet steam chamber, said nest of tubes, together with said inlet and outlet steam chambers defining a central volume within said elongated pressure vessel, at least one return conduit extending from said outlet steam chamber to said inlet steam chamber so as to extend through said central volume, said return conduit(s) enabling excess primary steam to be returned to said inlet steam chamber, and wall means extending inwardly from said elongated pressure vessel and toward said central volume to force secondary steam to be superheated which is flowing from said inlet conduit toward said outlet conduit to pass through said annular nest of tubes into said central volume and then allow said secondary steam to pass back through said annular nest of tubes away from said central volume.

2. A superheater according to claim 1, in which said at least one return conduit consists of one return conduit which passes centrally through said central volume.

3. A superheater according to claim 1, in which the inlet steam chamber has a circular cross-section and the supply conduit to said inlet steam chamber is disposed tangentially with respect to this circular crosssection so that the steam therein is given a rotational movement which induces a pressure distribution within the inlet steam chamber which decreases inwardly towards the center of the said inlet steam chamber, said at least one return conduit opening to said inlet steam chamber adjacent to the region of minimum pressure therein.

4. A superheater according to claim 3, in which a wall is provided in said inlet steam chamber which divides the latter into two volumes, both having a circular cross-section, said wall being provided with a central opening between the said two volumes, the inlet conduit opening into one of said volumes in the inlet steam chamber and the tubes of the said nest opening into the second of said two volumes.

5. A superheater according to claim 1, in which the inlet steam chamber is provided with means to influence the speed of rotation or recirculation of the primary steam.

6. A superheater according to claim 1, in which the tubes in the nest are annularly arranged in several layers around the central volume.

7. A superheater according to claim 1, in which the tubes in the nest are annularly arranged in several layers around the central volume.

8. A superheater according to claim 1, in which the central volume is divided into two or more portions by one or more radially oriented walls and the volume between the outermost tubes in the nest and the wall of the pressure vessel is divided into three or more portions by two or more radially oriented walls.

9. A superheater according to claim 7, in which the central volume is divided into two or more portions by one or more radially oriented walls and the volume between the outermost tubes in the nest and the wall of the pressure vessel is divided into three or more portions by two or more radially oriented walls.

10. A superheater according to claim 3, in which a plurality of return conduits are disposed in the central volume so that secondary steam flows around said conduits and further condensation of primary steam occurs therein.

11. An intermediate heater or the like, for example for a power plant, consisting of a pressure vessel comprising at least one nest of tubes for the condensation of primary steam therein and external superheating of secondary fluid, characterized in that the tubes in said at least one nest of tubes are arranged around at least one central volume and extend between an input steam chamber which is connected by way of at least one conduit to a steam source and an outlet steam chamber which is connected to at least one drainage conduit for discharge of condensed primary steam from the vessel; that the central volume is defined by the steam chambers and by the tube nest; that between the tube nest and the pressure vessel there are formed two other volumes separated by a wall which forces the secondary steam to pass the tubes radially inwardly from one outer volume to the central volume and, after axial passage through said central volume, to return radially outwardly transversely of the tubes to the outer volume; and that at least one return conduit extends from said outlet steam chamber to said inlet steam chamber so as to pass through said central volume, said return conduit(s) enabling excess primary steam to be returned to said inlet steam chamber.

* * * * *